US006921134B1

(12) United States Patent
Hong

(10) Patent No.: US 6,921,134 B1
(45) Date of Patent: Jul. 26, 2005

(54) APPARATUS FOR ADJUSTING INCLINATION OF CHAIR BACKS

(75) Inventor: Lin Yu Hong, Chiayi (TW)

(73) Assignee: Tung Yu O.A. Co., Ltd., Chiayi (TW)

( * ) Notice: Subject to any disclaimer, the term of this patent is extended or adjusted under 35 U.S.C. 154(b) by 0 days.

(21) Appl. No.: 10/768,592

(22) Filed: Jan. 30, 2004

(51) Int. Cl.[7] ..... A47C 1/032
(52) U.S. Cl. ..... 297/301.7; 297/300.8
(58) Field of Search ..... 297/301.1, 300.8, 297/301.3, 301.5, 301.6, 301.7, 302.7, 363–365

(56) References Cited

U.S. PATENT DOCUMENTS

| | | | | |
|---|---|---|---|---|
| 3,434,757 | A * | 3/1969 | Walkinshaw | 297/301.7 |
| 4,384,741 | A * | 5/1983 | Flum et al. | 297/300.8 |
| 5,762,399 | A * | 6/1998 | Liu | 297/302.7 |
| 6,033,020 | A * | 3/2000 | Ito | 297/302.4 |
| 6,139,103 | A * | 10/2000 | Hybarger et al. | 297/300.2 |
| 6,220,664 | B1 * | 4/2001 | Lee | 297/301.7 |
| 6,378,943 | B1 * | 4/2002 | Beggs et al. | 297/301.7 |
| 6,712,428 | B2 * | 3/2004 | Moreschi | 297/300.8 |

* cited by examiner

*Primary Examiner*—Peter R. Brown
(74) *Attorney, Agent, or Firm*—Alan D. Kamrath; Nikolai & Mersereau, P.A.

(57) ABSTRACT

An apparatus for adjusting the inclination of a chair back is disposed on the chassis at the bottom of a cushion and pivotally coupled to the middle of a base at the upper end of chair legs. A control rod has its middle predetermined position pivotally coupled to the base. A positioning plate has a bolt at its top surface and is disposed at the rear end of the base. A resilient component is pivotally coupled such that one end of the resilient component is hooked into an end of the control rod, and the other end of the resilient component being hooked into the bolt at the top surface of the positioning plate. When the control rod is turned to swing its end, the resilient component rotates, so that one of the resilient legs of the resilient component produces an elastic push onto the positioning plate. Thus, the positioning plate contracts and moves to embed into or withdraw from a latch groove disposed at the bottom rear side of the chassis. Therefore, the pushing force of a spring can be acted completely on the positioning plate, and the positioning plate can move smoother, making operation easier and simpler.

2 Claims, 6 Drawing Sheets

APPARATUS FOR ADJUSTING INCLINATION OF CHAIR BACKS

FIELD OF THE INVENTION

The present invention relates to an apparatus for adjusting inclination of chair backs, more particularly to an apparatus for adjusting the inclination of a chair back comprising a control rod disposed on the base of a chair and having a rotary end, with a reciprocal fixing plate being slidably embedded into or withdrawn from a latch opening disposed on the rear side of the chassis fixed on the bottom of a seat cushion.

BACKGROUND OF THE INVENTION

Taiwanese Patent No. 496133 disclosed an apparatus for controlling the inclination of a chair back, comprising: an air pressure rod disposed at the upper end of a chair leg and having an end passing through a base; and a chassis with a cushion disposed on the base. The fixed base and chassis are pivotally coupled together. A plurality of latch grooves extend downward from the rear side of the chassis. A guide base is disposed on the base and has a groove for accommodating a positioning plate. A sliding base is slidably disposed on the top surface of the guide base. A linear elongated hole and a slanted elongated hole are respectively disposed at the top surface of the guide base and sliding base. A screw passes through the elongated holes and mount the guide base and the sliding base onto the positioning plate accommodated in the groove.

An ear section of a reciprocating rod passes through one side of the sliding base, and a spring is disposed on each side of the reciprocating rod. Thus, both external sides of the spring are blocked by a blocking member at the end of the reciprocating rod. One, and one end of the reciprocating rod is fixed onto a control rod for controlling the inclination of the chair back. Therefore, when the control rod is pushed to drive the sliding base to move, and when the control rod is further pushed by a resilient prestressing force of the spring and the slanted elongated hole, the positioning plate is extended into or withdrawn from the groove to embed or withdraw the positioning plate respectively into or from the latch groove disposed at the end of the chassis for adjusting the inclination of the chair back.

However, the force of the spring driving the sliding base to move is perpendicular to the moving direction of the positioning plate and drives the positioning plate to move the elongated hole to a slanted position. As a result, the force for moving the positioning plate is only half of the force for the spring to move the sliding base. Further, the force for moving the positioning plate will be reduced drastically by the friction between the sliding base and the guide base and by the friction between the positioning plate and the groove.

Thus, the positioning plate will be easily stuck into the groove. Although the resilience of the spring can be increased to strengthen the force to push the positioning plate, it also requires users to apply a larger force to push the control rod. Therefore, a larger force is needed for operation. Since the direction of applying force to operate the control rod and the direction of the reaction of the spring have the same axial direction, the operation of the control rod will be unsmooth and uneasy, particularly when a larger force is needed to operate the control rod.

SUMMARY OF THE INVENTION

Making the movements of the positioning plate smoother and the operation easier and simpler for users is exactly the objective of this invention. Therefore, the present invention adopts a power-saving lever structure to control the control rod and achieve the purpose of an easy operation and greatly enhance the force to move the positioning plate.

According to the present invention, the spring applies a force to push the positioning plate in the same direction as the moving direction of the positioning plate. Thus, the pushing force applied to the positioning plate by the spring can be acted completely onto the positioning plate without any loss, making the movement of the positioning plate smoother.

The technical measures adopted to achieve the foregoing objectives include a base pivotally coupled to a middle predetermined position of the control rod, and a resilient component having two resilient legs. One of the resilient legs is hung at an end of the control rod, and the other resilient leg is hooked onto the positioning plate slidably disposed on the base. The direction of pushing by the resilient leg is vertical to the moving direction of the positioning plate. Therefore, when the control rod is pushed to swing its end and drives the resilient leg to rotate, one of the resilient legs pushes or pulls the positioning plate to embed into or withdraw from a latch groove disposed at the bottom rear side of the chassis.

DETAILED DESCRIPTION OF THE PREFERRED EMBODIMENTS

The detailed description and technical characteristics of the present invention are described together with the drawings as follows.

Figure 1:
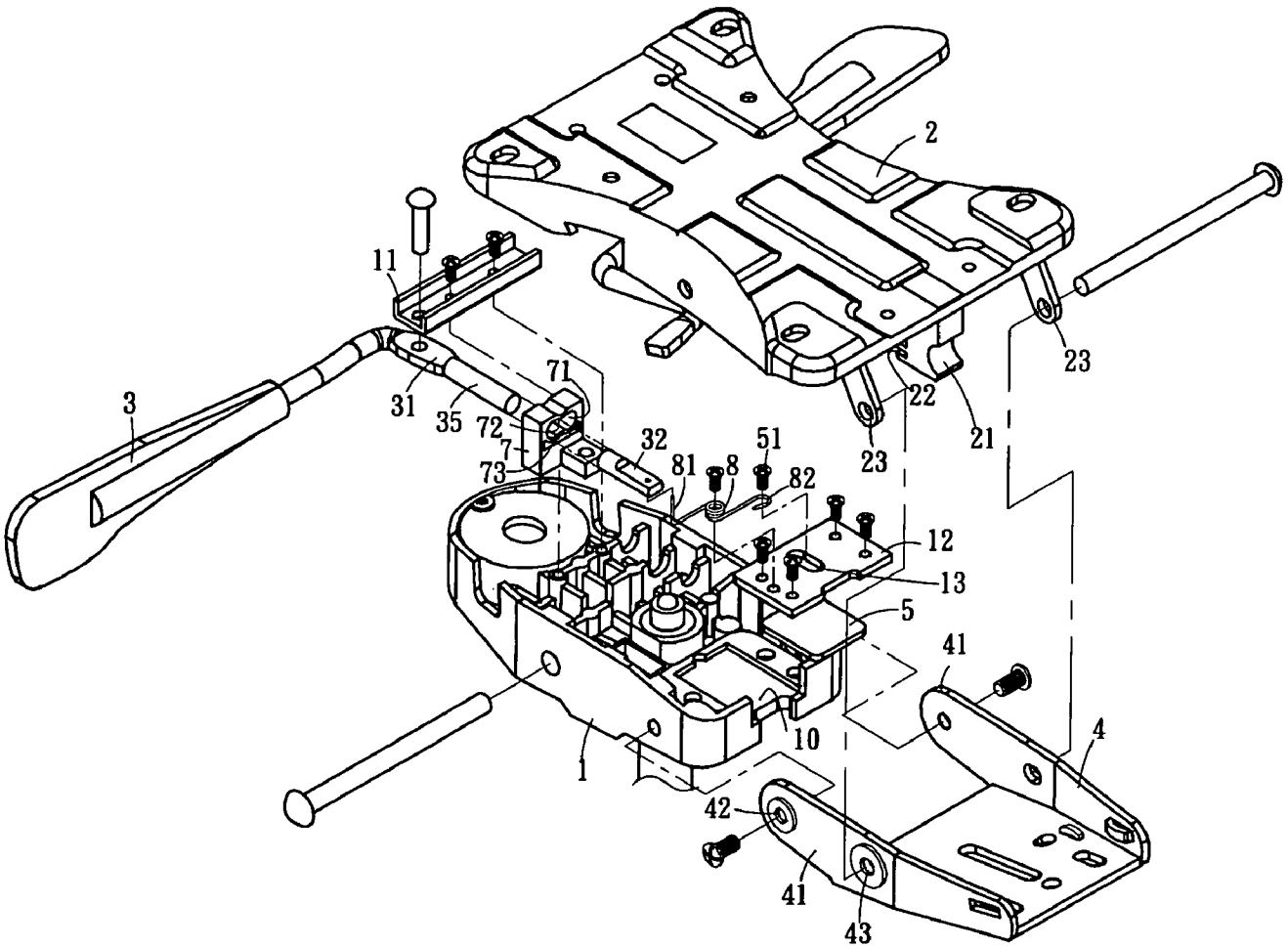
FIG. 1 is a perspective view of the disassembled parts of the structure according to the present invention.
Figure 2:
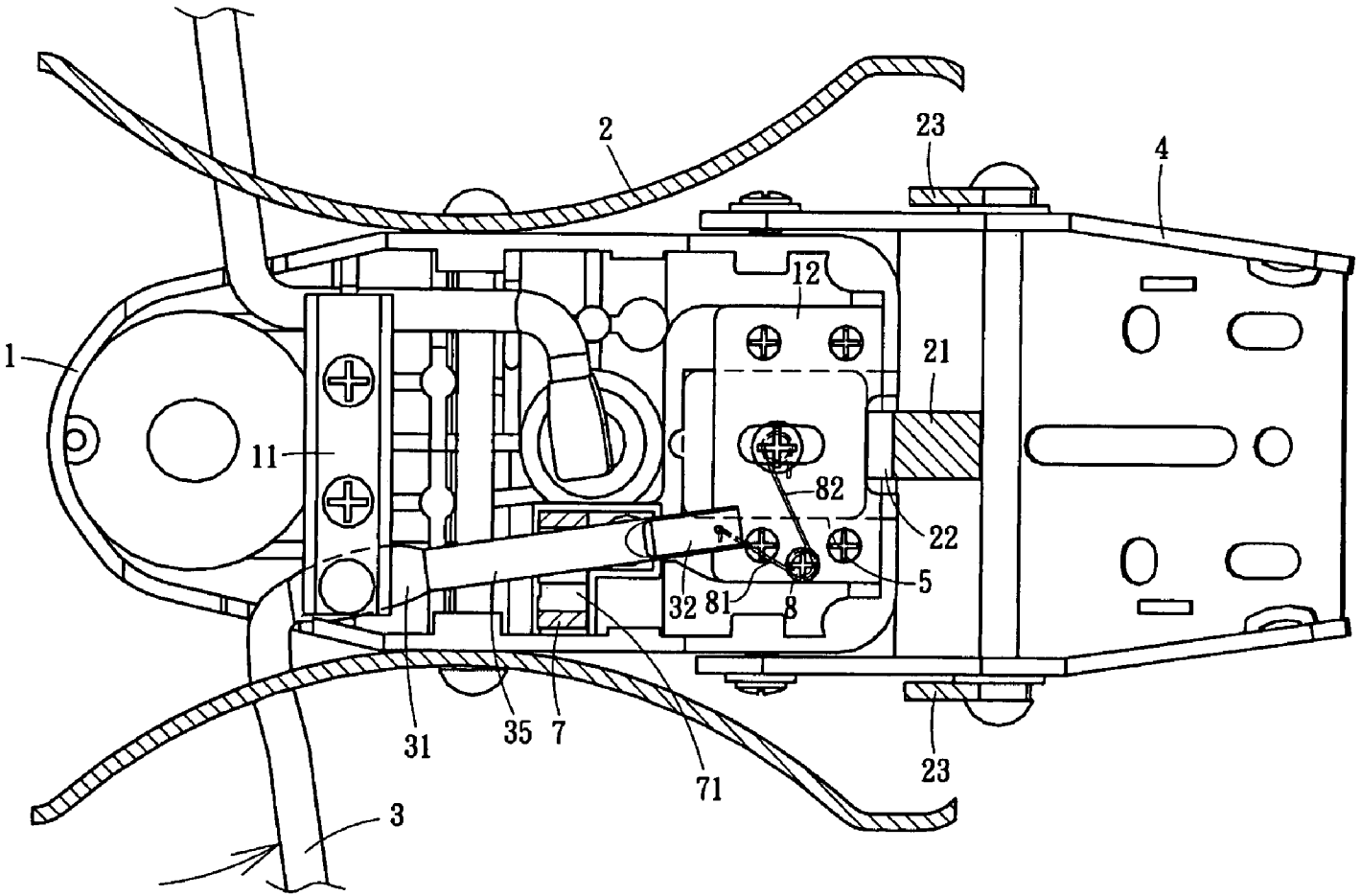
FIG. 2 is a top view of the apparatus for adjusting the inclination of a chair back according to the present invention.
Figure 3:
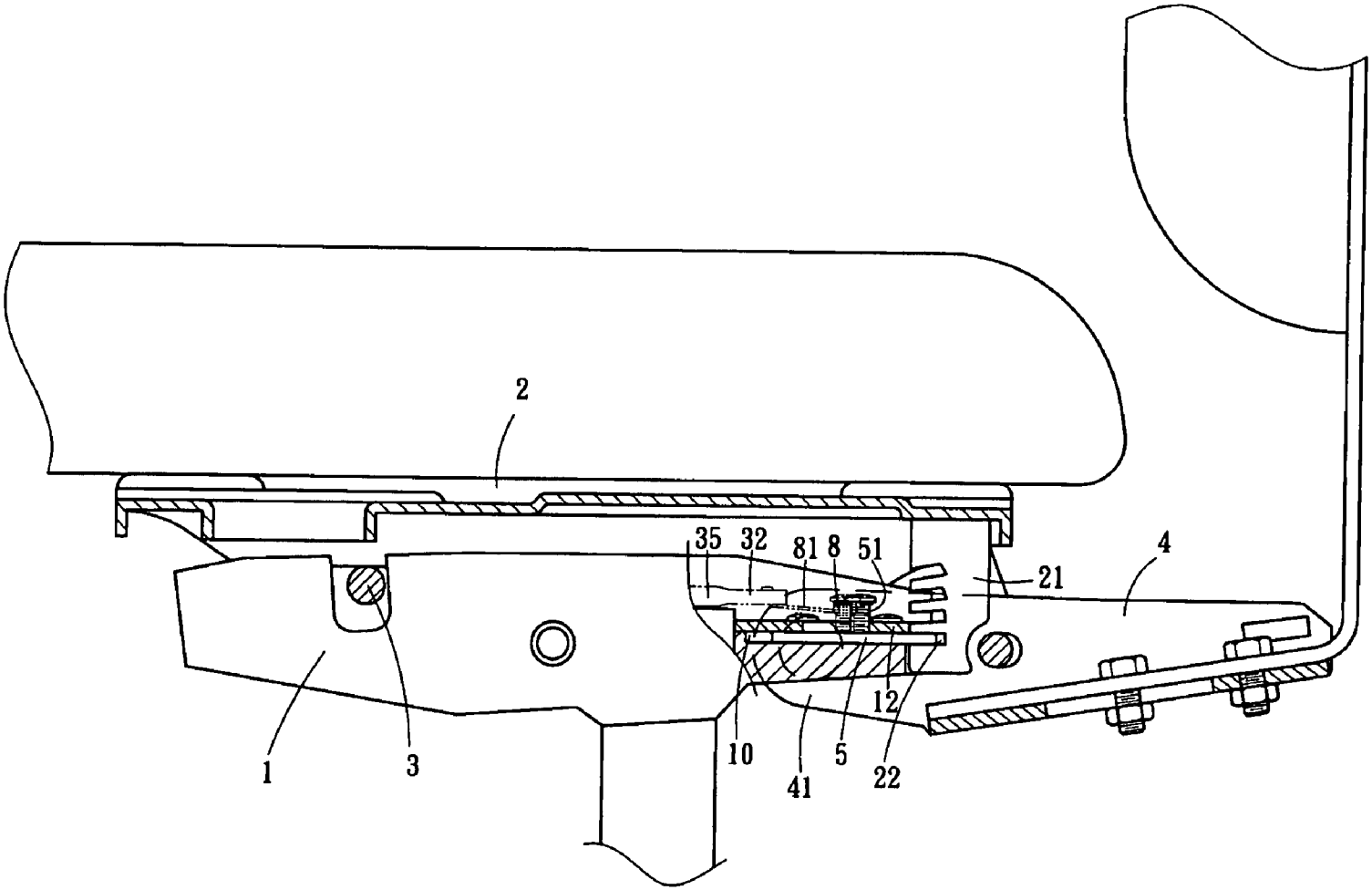
FIG. 3 is a cross-sectional view of a side of the apparatus for adjusting the inclination of a chair back according to the present invention.

Referring to FIGS. 1, 2, and 3, an apparatus for adjusting the inclination of a chair back according to the present invention comprises a base 1 disposed at the upper end of a chair leg, and a chassis 2 disposed at the bottom of a cushion of a chair. The base 1 and the chassis 2 are pivotally coupled together in the middle. The rear end of the base 1 is pivotally coupled to a through hole 42 at the front end 41 of a swing frame 4. A through hole 43 disposed on both sidewalls of the swing frame 4 is pivotally coupled to a link arm 23 extended from both sides at the rear side of the chassis 2. A positioning member 21 is fixed to the middle section of the bottom at the rear side of the chassis 2. A plurality of latch grooves 22 are disposed on the positioning member 21.

Figure 4:
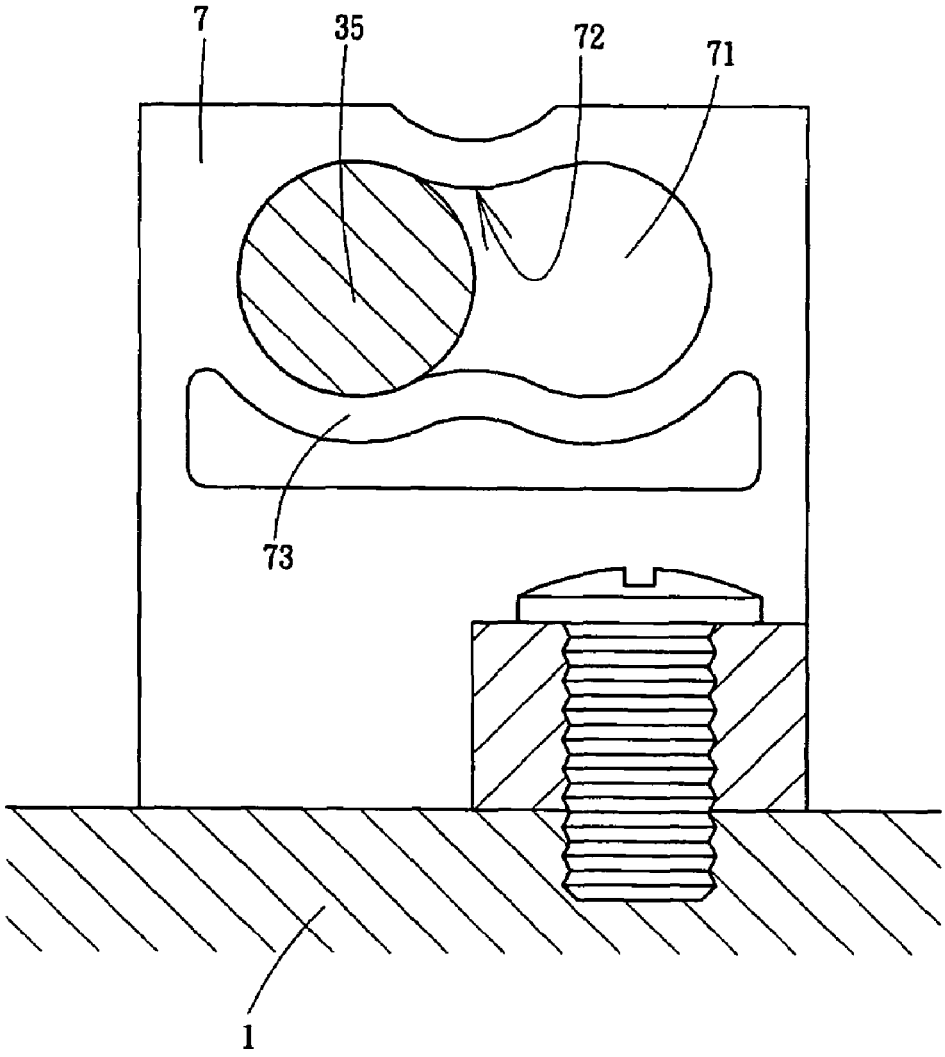
FIG. 4 is a partial view of the latch member according to the present invention.

Further, an end of a control rod 3 is extended out from the base 1. A middle predetermined position 31 of the control rod 3 is pivotally coupled to a fixed base 11. The fixed base 11 is mounted onto the base 1. The middle of the control rod 3 passes through the latch member 7 (as shown in FIG. 4) fixed in the base 1. An accommodating groove 71 is disposed on the latch member 7 for accommodating the rod body 35 of the control rod 3. A blocking protrusion 72 is disposed at the middle of the accommodating groove 71 and has a size smaller than the rod body 35 of the control rod 3. A hollow space is disposed in the accommodating groove 71 to define a resilient section 73 in the middle, such that the blocking protrusion 72 can have an elastic latch action to provide smooth movement and positioning between both ends of the accommodating groove 71 of the rod body 35.

Further, the control rod 3 continues to extend to define an end section 32 having a through hole. A sliding groove 10 is disposed in the middle at the rear end of the base 1. A sliding positioning plate 5 is disposed in the sliding groove 10. A cover 12 having an elongated hole 13 at its top surface covers the positioning plate 5 and allows the positioning plate 5 to move back and forth. The front end of the positioning plate 5 can be extended out into any latch groove 22 at the rear side of the chassis 2. The positioning plate 5 has a bolt 51 at its top surface, with the bolt 51 passing through the elongated hole 13 of the cover 12. A resilient member 8 is pivotally coupled onto the cover 12 for free rotation. The resilient member 8 has two resilient legs 81, 82, wherein one of the resilient legs 81 is hooked into the through hole at the end section 32 of the control rod 3, and the resilient leg 82 at the other end is hooked into the bolt 51.

Figure 5:
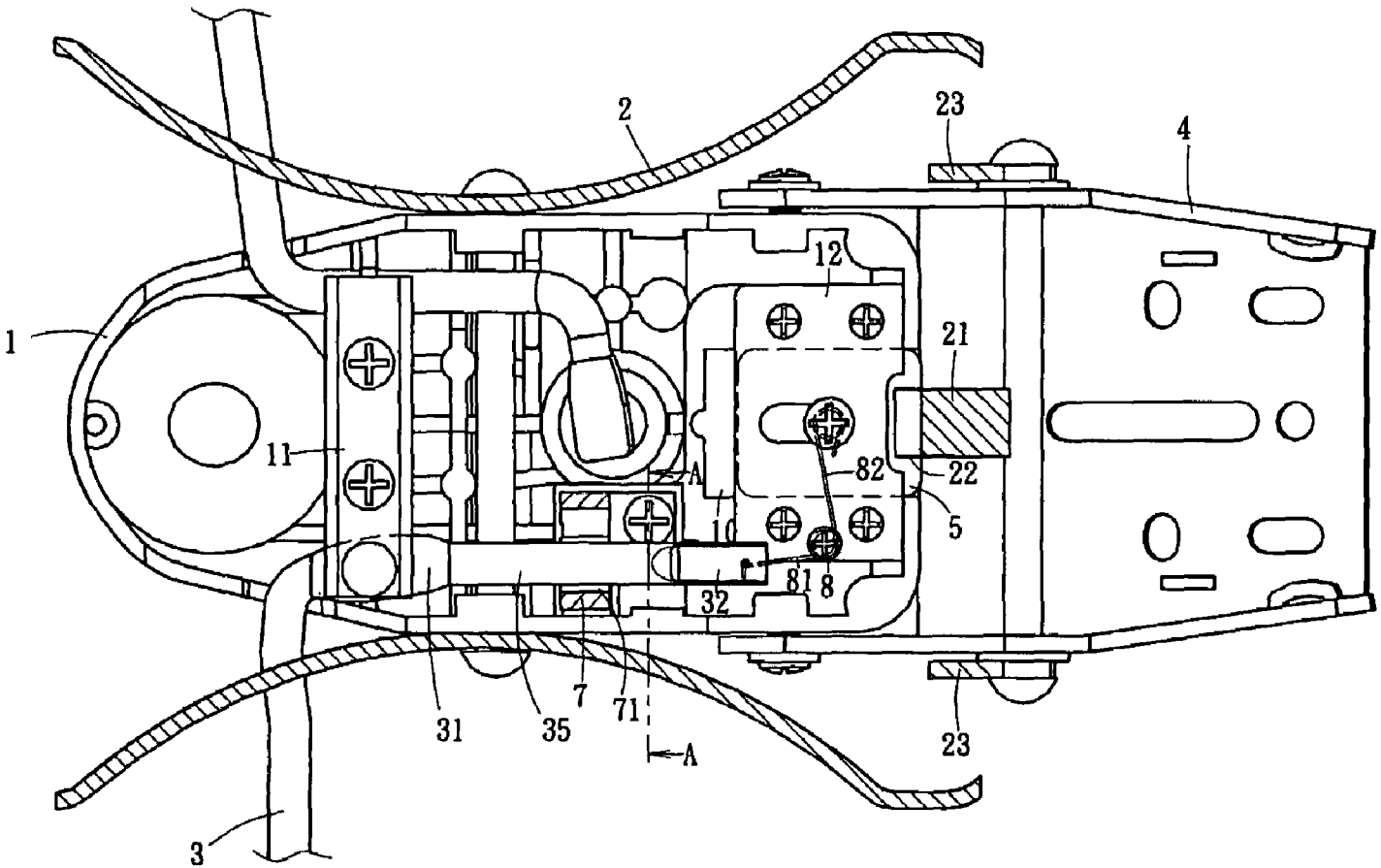
FIG. 5 is a view of the fixing plate being withdrawn from the latch groove according to the present invention.
Figure 6:
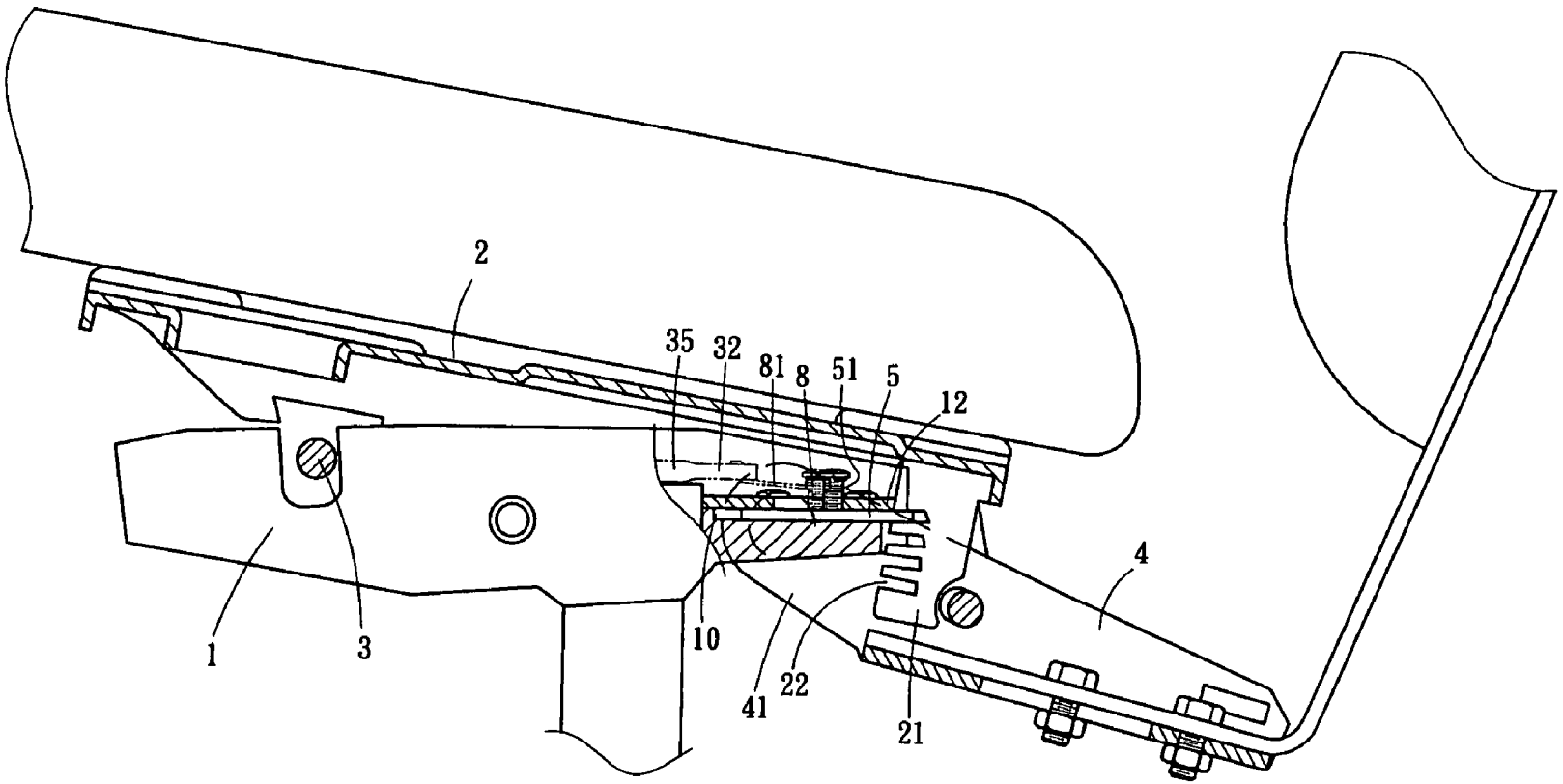
FIG. 6 is a view of the movements of adjusting the inclination of a chair back according to the present invention.

Referring to FIGS. 5 and 6, when the external end of the control rod 3 is pushed, the rod body 35 at the middle section will be embedded from one end of the accommodating groove 71 of the latch member 7 to the other. The rod body 35 is blocked in position by the resilient section 73 in the middle of the blocking protrusion 72. The end section 32 of the control rod 3 will swing to force the resilient leg 81 to extend outward. Thus, the resilient member 8 produces a rotary prestressing force, and the resilient leg 82 at the other end produces a prestressing force to shift the positioning plate 5 to the left. Therefore, when the chair back is pressed and released by reciprocating actions, the positioning plate 5 originally embedded and clamped by the latch groove 22 produces a loosened gap. Thus, the positioning plate 5 can be withdrawn from the latch groove 22 by a push produced by the prestressing force of the resilient leg 82. After the chair back is adjusted to the user's desired inclination, the control rod 3 is pushed in the opposite direction such that the end section 32 swings back to the original vertical position. Then, the resilient leg 82 will produce a prestressing force to push the bolt 51 to the right. When the chair back is swung to a predetermined inclination and the positioning plate 5 is aligned with the desired latching groove 22, the front end of the positioning plate 5 will snap into the latch groove 22 and latch the chair back.

Therefore, the control rod 3, being pushed by swinging with a power-saving lever structures can greatly increase the force to push the positioning plate 5. The user can save power for the operations, thus making the operation easier. Since the direction of applying force of the resilient leg 82 of the resilient component 8 for pushing the positioning plate 5 is in the same direction as the positioning plate 5 shifts, therefore the pushing force by the resilient leg 82 is acted completely onto the positioning plate 5 without any loss. As a result, the positioning plate 5 is pushed with a larger force and shifts in a smoother manner.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. An apparatus for adjusting inclination of chair backs, comprising:

a base pivotally coupled to a middle of a chassis;

a plurality of latch grooves disposed at a bottom at a rear side of said chassis;

a positioning plate disposed at a top surface at a rear end of said base for being slid back and forth, with an extended front end of said positioning plate being extended into one of the said latch grooves;

a control rod having a middle predetermined position pivotally coupled to said base, with an end section of said control rod being freely swung; and a rod body disposed on said positioning plate and pivotally coupled to a free rotary resilient component having first and second resilient legs, with the first resilient leg being coupled to an end of said control rod, and the second resilient leg being hooked into a bolt disposed on said positioning plate; thereby when said control rod being pushed to swing said end section back and forth produces a rotary prestressing force by said resilient component to move the positioning plate to selectively embed into and withdraw from one of said latch grooves disposed at the rear side of said chassis.

2. The apparatus for adjusting inclination of chair backs of claim 1, wherein said base disposed at a middle of said control rod comprises a latch member having an accommodating groove thereon for letting a rod body of said control rod to pass through, and a middle of said accommodating groove is slightly smaller than a resilient blocking protrusion on the rod body of said control rod.

* * * * *